United States Patent [19]

Cowan

[11] Patent Number: 4,535,994

[45] Date of Patent: Aug. 20, 1985

[54] BOARD GAME APPARATUS

[76] Inventor: William P. Cowan, 118 Chapel Hill Dr., Brentwood, N.Y. 11717

[21] Appl. No.: 487,101

[22] Filed: Apr. 21, 1983

[51] Int. Cl.[3] ..... A63F 3/00

[52] U.S. Cl. ..... 273/256; 273/146

[58] Field of Search ..... 273/256

[56] References Cited

U.S. PATENT DOCUMENTS

| | | | |
|---|---|---|---|
| Re. 29,355 | 8/1977 | Lefevre et al. . | |
| 168,570 | 10/1875 | Lamb . | |
| 289,043 | 11/1883 | Waller . | |
| 1,482,708 | 2/1924 | Small . | |
| 1,524,254 | 1/1925 | Johnson . | |
| 2,088,137 | 7/1937 | McAbee . | |
| 2,088,951 | 8/1937 | Fry . | |
| 2,131,653 | 9/1938 | Amsterdam . | |
| 2,133,515 | 10/1938 | Horton . | |
| 2,174,058 | 9/1939 | McGennis . | |
| 2,210,201 | 8/1940 | Draper et al. . | |
| 2,484,051 | 10/1949 | Robbins . | |
| 2,526,300 | 10/1950 | Todd . | |
| 2,666,644 | 1/1954 | Strehlow et al. | 273/256 |
| 2,673,738 | 3/1954 | Jenkins . | |
| 2,794,642 | 6/1957 | O'Neill . | |
| 2,976,044 | 3/1961 | Corpening | 273/256 |
| 3,050,303 | 8/1962 | Borci . | |
| 3,058,747 | 10/1962 | Nemetsky et al. . | |
| 3,109,652 | 11/1963 | Strand et al. | 273/256 |
| 3,163,423 | 12/1964 | Jackson . | |
| 3,163,424 | 12/1964 | Lindsey . | |
| 3,198,521 | 8/1965 | Kramer et al. . | |
| 3,222,070 | 12/1965 | Derrington et al. . | |
| 3,237,948 | 3/1966 | Murray . | |
| 3,254,894 | 6/1966 | Kollmeyer et al. . | |
| 3,397,890 | 8/1968 | Newton . | |
| 3,467,387 | 9/1969 | Schmitt . | |
| 3,499,646 | 3/1970 | Burgess et al. . | |
| 3,528,663 | 9/1970 | Curtz et al. . | |
| 3,539,189 | 11/1970 | Shelton . | |
| 3,559,993 | 2/1971 | Thomas . | |
| 3,740,037 | 6/1973 | de Bono . | |
| 3,761,093 | 9/1973 | Migliore | 273/284 X |
| 3,765,682 | 10/1973 | Braude . | |
| 3,770,277 | 11/1973 | Cass . | |
| 3,799,549 | 3/1974 | Laker | 273/284 X |
| 3,799,552 | 3/1974 | Lefevre et al. . | |
| 3,807,739 | 4/1974 | Henley et al. | 273/256 |
| 3,865,380 | 2/1975 | Thomas . | |
| 3,980,307 | 9/1976 | Raub . | |
| 4,002,342 | 1/1977 | Biggs | 273/256 X |
| 4,131,281 | 12/1978 | Taylor | 273/248 |
| 4,266,775 | 5/1981 | Chitnis et al. | 273/278 |
| 4,283,059 | 8/1981 | Beeder | 273/254 |
| 4,312,510 | 1/1982 | Bodner . | |
| 4,354,684 | 10/1982 | McKinley . | |

FOREIGN PATENT DOCUMENTS

| | | | |
|---|---|---|---|
| 1131667 | 9/1982 | Canada | 273/256 |

OTHER PUBLICATIONS

The Playboy Winner's Guide to Board Games.
The Leisure Time Games Catalog.
Rules of Monopoly.
Rules of Venture.
Rules of Anti-Monopoly.
Rules of Acquire.
Rules of Fortune 500.
Rules of the American Dream Game.
Rules of Billionaire.
Rules of Stock Market.

*Primary Examiner*—Richard C. Pinkham
*Assistant Examiner*—Scott Brown
*Attorney, Agent, or Firm*—Brumbaugh, Graves, Donohue & Raymond

[57] ABSTRACT

This invention relates to board games, and more particularly to the apparatus for such a game which combines the elements of strategic skill, chance and knowledge of corporate finance and the business world to provide entertainment for two or more players. The game includes a track with industry segments further subdivided into corporation spaces. Ten corporate shares corresponding to each corporation space are utilized with a pair of dice. The dice are numbered from zero to five and direct the movement of the playing pieces as well as the maximum number of corporate shares a player may buy.

7 Claims, 10 Drawing Figures

FIG. 2A
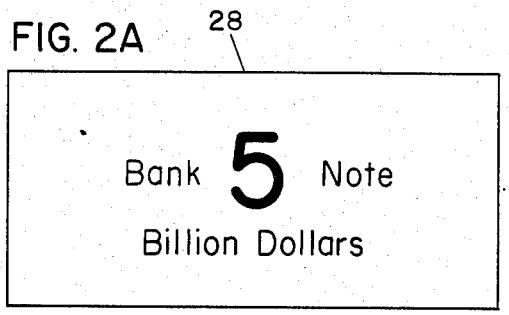
FIG. 2B
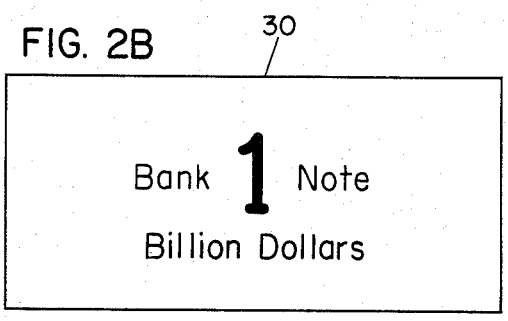
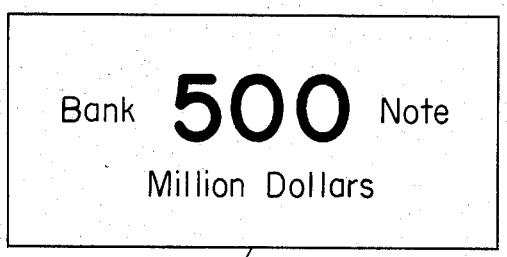
FIG. 2C 32
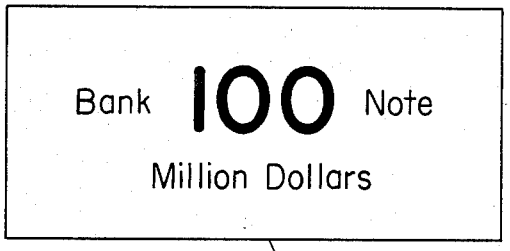
FIG. 2D 34
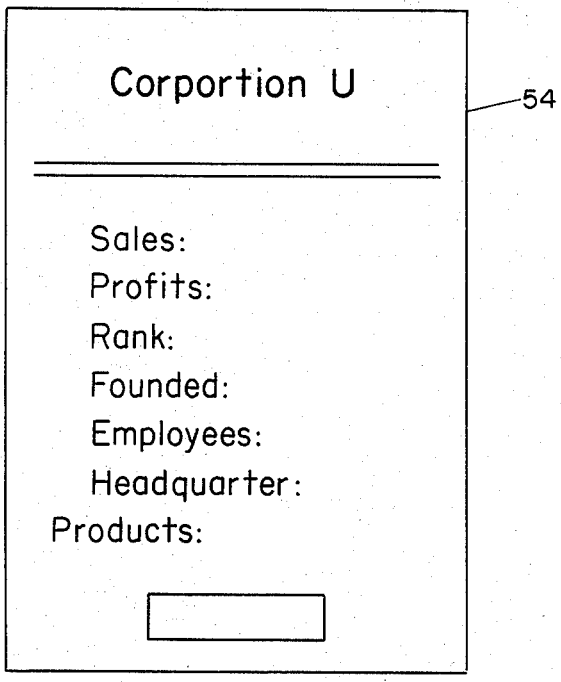
FIG. 3
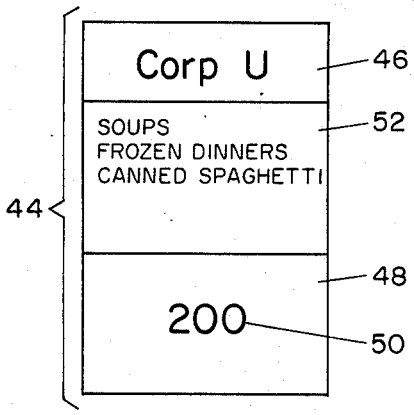
FIG. 4
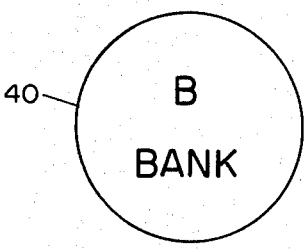
FIG. 5
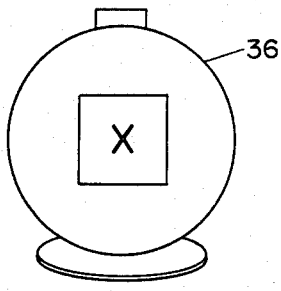
FIG. 6

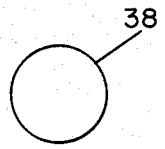
FIG. 7
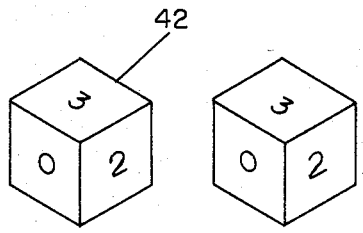
FIG. 8
| Price/ Share or Income | Number of Shares | | | | | | | | | |
|---|---|---|---|---|---|---|---|---|---|---|
| | 1 | 2 | 3 | 4 | 5 | 6 | 7 | 8 | 9 | 10 |
| 100 | 100 | 200 | 300 | 400 | 500 | 600 | 700 | 800 | 900 | 1 Billion |
| 200 | 200 | 400 | 600 | 800 | 1B | 1B200 | 1B400 | 1B600 | 1B800 | 2B |
| 300 | 300 | 600 | 900 | 1B200 | 1B500 | 1B800 | 2B100 | 2B400 | 2B700 | 3B |
| 400 | 400 | 800 | 1B200 | 1B600 | 2B | 2B400 | 2B800 | 3B200 | 3B600 | 4B |
| 500 | 500 | 1B | 1B500 | 2B | 2B500 | 3B | 3B500 | 4B | 4B500 | 5B |
| 600 | 600 | 1B200 | 1B800 | 2B400 | 3B | 3B600 | 4B200 | 4B800 | 5B400 | 6B |
| 700 | 700 | 1B400 | 2B100 | 2B800 | 3B500 | 4B200 | 4B900 | 5B600 | 6B300 | 7B |
| 800 | 800 | 1B600 | 2B400 | 3B200 | 4B | 4B800 | 5B600 | 6B400 | 7B200 | 8B |
| 900 | 900 | 1B800 | 2B700 | 3B600 | 4B500 | 5B400 | 6B300 | 7B200 | 8B100 | 9B |
| 1000 | 1B | 2B | 3B | 4B | 5B | 6B | 7B | 8B | 9B | 10B |
| 2000 | 2B | 4B | 6B | 8B | 10B | 12B | 14B | 16B | 18B | 20B |
| 3000 | 3B | | | | | | | | | |
FIG. 9

BOARD GAME APPARATUS

This invention relates to board games, and more particularly to the apparatus for such a game which combines the elements of strategic skill, chance and knowledge of corporate finance and the business world to provide entertainment for two or more players.

The game is based on the acquisition of shares in corporations in order to acquire ownership of the corporations in several industries and thereby to gain control of one or more industries. The area of play imprinted on the game board is a track preferably circular divided radially into several industry segments. Each segment represents an industry, for example, publishing, chemical, photography, food and beverage, supermarkets and retail stores. Each of the industry segments is radially subdivided into several corporation spaces each of which represents a particular corporation within the industry represented by the segment. The corporation space is divided horizontally into at least three sections. The upper section bears the name and/or logo of an actual U.S. or foreign corporations or of a fictitious corporation with a fanciful name. The selection of corporations can be varied to allow for game boards for a particular city, county, state or region. The middle section contains a number which represents the corporation's income, and the lower section contains a number which represents the price of one share in the corporation. The industry segments are separated from each other by situation spaces.

The other principal elements of the game are a set of different bank notes in various denominations; for example five billion dollar notes, one billion dollar, five hundred million dollars and one hundred million, playing pawns for movement by each of the players, a bank loan marker for each player to indicate when a corporation's shares have been pledged by a player as collateral for a bank loan, a government contract fund box to hold tax money collected during the game, a pair of special dice numbered 0 to 5 for governing the movement of the playing pawns around the board, corporate shares for each of the corporations in the different industries represented on the game board, a set of full ownership markers for each player used to indicate when a particular player own all shares of a given corporation and corporation fact sheets containing business information about each of the corporations represented on the game board.

Play of the game may be briefly summarized as follows. At the beginning of play, each player selects a colored pawn. The color of the pawn corresponds to the color of a set of full ownership markers and bank loan marker. The government contract fund box is placed on the game board and one player is selected to be the investment banker (herein after banker) who oversees the activity of the bank. To start the game, each player is given a set of money, for example five, 5-billion dollar bank notes, ten, 1-billion dollar bank notes, 10, 500-million dollar bank notes and ten, 100-million dollar bank notes.

The starting point for each player is the situation space labeled START:ANY PLAY. Movement of each playing pawn is clockwise and is governed by a roll of the dice. The order of play may be governed by roll of the dice or some other random selection.

For each roll of the dice, the player moves the pawn clockwise the number of spaces corresponding to the sum of the numbers on the uppermost faces of the two dice rolled, (herein "number rolled") the object being to move the pawn to a corporation space and thereby buy or sell corporation shares in order to enable the player to eventually gain full ownership of all corporations in one industry. On reaching an unowned corporation space, the player may pass or buy shares in the corporation up to the number rolled. On reaching a corporation space for which shares are held by other players and the bank, he may attempt to buy shares as explained in detail below, from all of these sources. The first player to gain ownership of all the shares of all of the corporations in one industry is the winner of the game. Preferably each corporation has a total of ten shares. In alternate embodiments the game can be played until 2 or 3 industries are controlled by one player.

As will be explained more fully below, various impediments, bonuses, situations and strategies are available to the players to make the buying and selling of shares and aquisition of the corporations easier or more difficult. The game is capable of a wide range of variations in play, and the format of the board and of the other game elements may be widely varied, as will become apparent from the following detailed description of a preferred embodiment, taken in conjunction with the accompanying drawings.

BRIEF DESCRIPTION OF THE DRAWINGS

FIG. 2 shows samples of the type of bank notes which can be used in this game.

FIG. 3 illustrates a corporation fact sheet.

FIG. 4 illustrates a corporation share.

FIG. 5 illustrates a bank loan marker.

FIG. 6 illustrates the playing pawns employed during play of the game.

FIG. 7 illustrates a full ownership marker.

FIG. 8 illustrates the special dice employed during play of the game.

FIG. 9 illustrates the optional Share Buying and Selling Chart.

DETAILED DESCRIPTION OF PREFERRED EMBODIMENT

The principal components of the preferred embodiment of the game are (1) the game board, (2) the corporate shares, (3) the corporate fact sheets, (4) the full ownership markers, (5) the bank loan markers, (6) the bank notes, (7) the two dice each numbered 0 to 5 and (8) the playing pawns. Each component will be described in detail below, together with a description of the manner of play and the rules governing a preferred form of the game.

THE GAME BOARD

Figure 1:
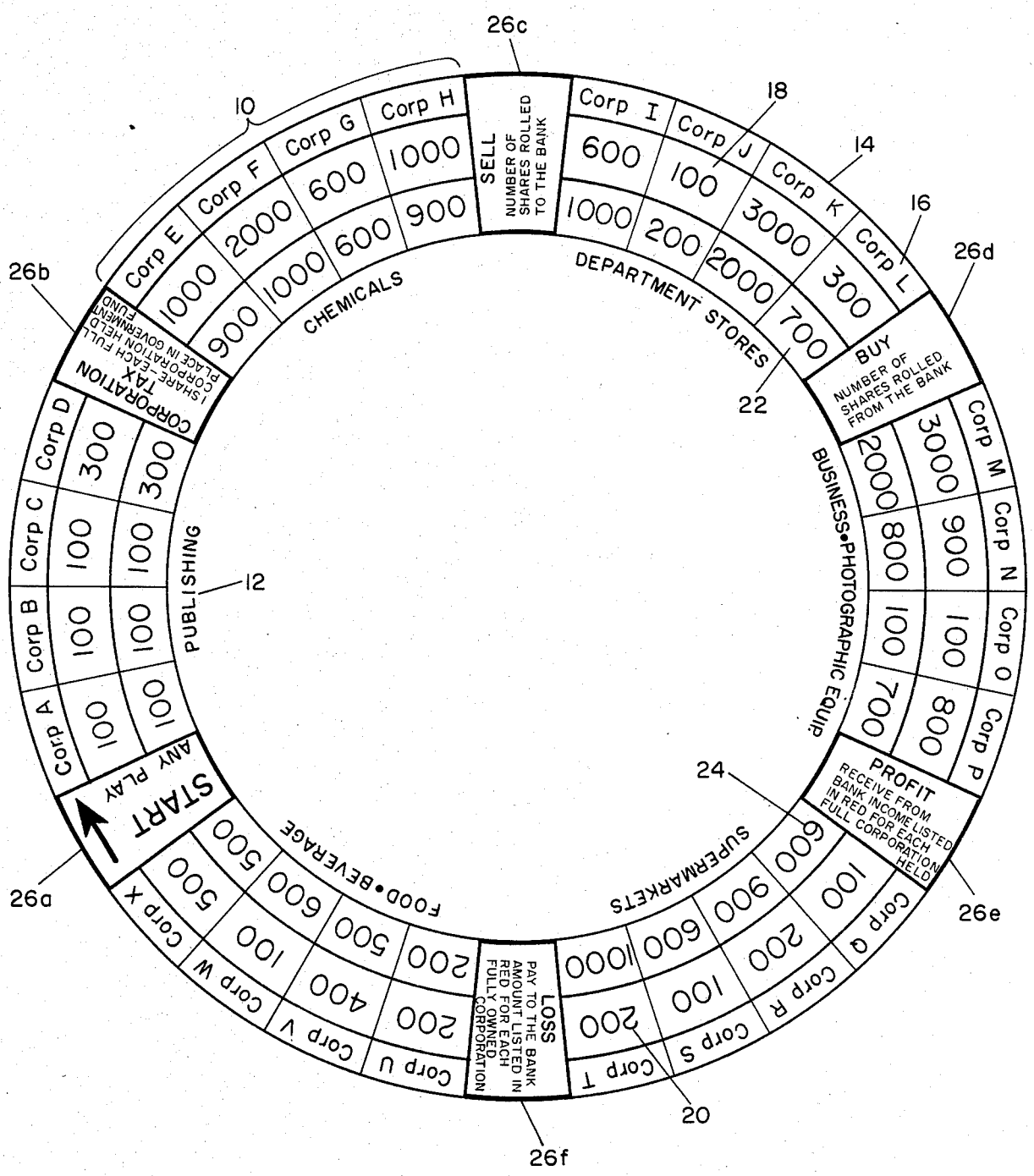
FIG. 1 illustrates a preferred embodiment of the game board with the playing surface.

The preferred format of the game board is shown in FIG. 1 and is preferably played by two to four players. As illustrated, the board contains a circular track having an inner and outer circumference. The shape of the track can vary, for example it can be pentagonal, hexagonal or octagonal in shape. The track is divided radially into industry segments 10. The board is preferably divided into six segments but the number of segments can be varied to suit the shape of the track. Each segment 10 represents an industry or area of business, for example, publishing, chemicals, photography, food and beverages, supermarkets and retail stores. These segments may be indicated by different colors which correspond to the colors on the corporation shares 44, and corporation fact sheets 54. The name 12 of the industry represented by each industry segment 10 is indicated below the inner circumference of the track under each segment. In the preferred embodiment, each of the six industry segments is radially subdivided into four corporation spaces 14 each of which represents a particular corporation within the industry segment. The segments, however, can be divided into any convenient number of corporation spaces.

The corporation space 14 is divided horizontally into at least three sections. The upper section 16 contains the corporation's name and/or logo. The corporations can be an actual United States or foreign corporation or can be fanciful and/or arbitrary as illustrated in FIG. 1. The middle section 18 contains an income number 20 which represents the corporation's income, for example in a hundred million dollars. This income is paid on various occasions during the play of the game to a player who owns all the shares in a given corporation. In the preferred embodiment, the income figure is in red. The lower section 22 of the corporation space contains a price per share number 24 which represents the list price, for example in a hundred million dollars, of one share of the corporation. In a preferred embodiment the list price is in black. The income number 20 and price per share number 24 generally varies for each corporation and the game can be designed to include income numbers and price per share numbers for corporations of similar and dissimilar values. Small corporations having values in terms of a hundred thousand dollar units could be included or for use by children, corporations could be used in which the income and price per share is expressed in a hundred dollar unit. Very large corporations would require list prices and income numbers in ten million dollar units.

Figure 10:
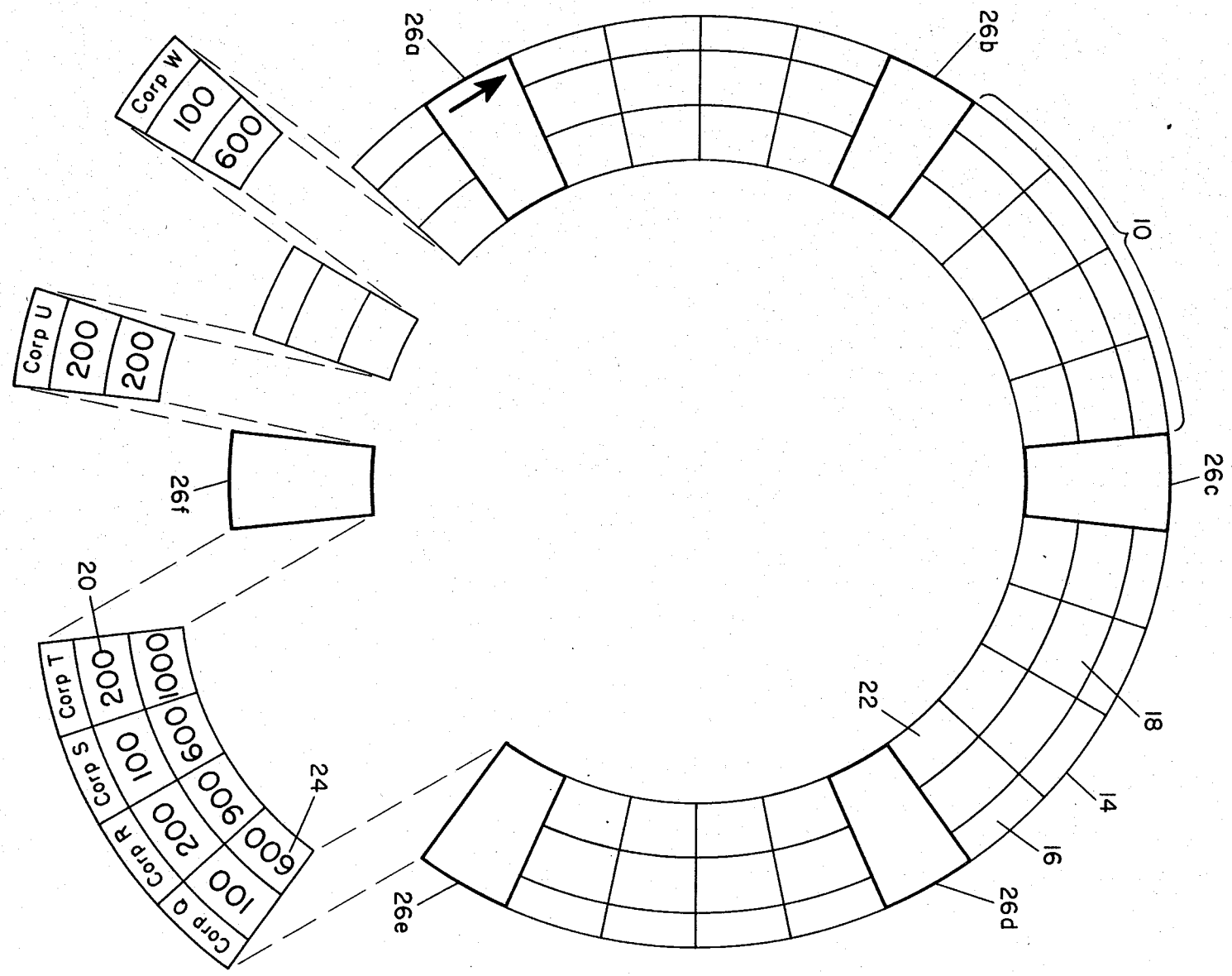
FIG. 10 illustrates the interchangeable corporate spaces and industry segments.

In an alternate embodiment as shown in FIG. 10 the entire track or the individual corporation spaces 14 or industry segments 10 could be made as separate interchangeable pieces which are set into the game board like pieces of a jig saw puzzle. This version would come equipped with several sets of tracks or segments or corporation spaces and would allow the player to change the corporations, industries or the entire game board in order to add variety to the game.

Each industry segment 10 is separated from the next industry segment by a situation space *26a, 26b, 26c, 26d, 26e, 26f*. A situation space presents circumstances under which a player's financial and corporate situation during the game may change favorably or unfavorably. The situation space labeled "START:ANY PLAY" *26a* gives the player a series of options for buying shares, collecting income and paying off loans. The specific situations created by START:ANY PLAY will be explained more fully below.

The situation space labeled CORPORATION TAX *26b*, presents a situation where a player, if he lands on that space, must pay a tax equal to the value of one share for each corporation which he fully owns. If the player does not fully own at least one corporation, he pays no tax. The situation space labeled SELL *26c* presents a situation in which the player who lands on that space must sell the number of corporation shares equal to the number rolled on the dice. If the player holds no shares, no action is required. The sale of shares, in this situation, may be to the banker or to other players as the Seller desires. The situation space labeled BUY *26d* presents the player with a situation where he must buy shares of available corporations equal to the number rolled on the dice. The Situation Space labeled PROFIT *26e* presents the player who owns one or more corporations with a situation where he receives money from the bank. The money he receives is equal to the income figure 20 in the middle section 18 of the corporation space 14 for each corporation he owns. This can be easily illustrated by the following example.

EXAMPLE 1

A player who owns Corporation T and Corporation F as illustrated in FIG. 1, lands on the PROFIT space. Income to the player for landing on this situation space is the 2 billion dollar income figure for Corporation F plus the 3 million dollar income figure for Corporation T.

The situation space labeled LOSS *26f* presents a situation where the player who lands on that space must pay the bank the income figure 20 for each corporation which he owns. If, for example, a player owns Corporations K and N as illustrated in FIG. 1, he must pay the bank 3 billion, 900 million dollars.

BANK NOTES

In the embodiment illustrated in FIGS. *2a–2d*, a total of four denominations of bank notes are used. There are 50 five billion dollar notes 28 (herein a five note), which bear the number 5; 50 one billion dollar notes 30 (herein a one note) which bear the number 1; 50 five hundred million dollar notes 32 (herein a five hundred note) which bear the number 500 and 50 one hundred million dollar notes 34 (herein a hundred note) which bear the number 100. Each domination of bank note can be made in a different color. For example, blue, pink, white and yellow. At the beginning of play, each player receives 5 five notes, 10 one notes, 10 five hundred notes and 10 hundred notes.

If the corporations appearing on the game board are foreign the bank notes could be in the currency of that country, for example, pounds in Great Britain and francs in France. In a country, for example, Italy, where higher denominations might be required to purchase shares, the bank notes would be, for example, five trillion lire; one trillion lire; five hundred billion lire and one hundred billion lire. The number of notes distributed to each player in any case remains the same (5, 10, 10, 10).

In an alternate embodiment, the game board could contain corporation spaces for small corporations with assets from about one to ninety million dollars. In this embodiment, the price per share and income figures would be expressed in one hundred thousand dollars. In that case, the bank notes would be five million dollars; one million dollars; five hundred thousand dollars and one hundred thousand dollars. The number of notes distributed to each player would remain the same (5, 10, 10, 10). If large corporations having values of from 90 million to 100 million dollars are used the bank notes would be in denominations of five hundred million dollars; one hundred million dollars; fifty million dollars and ten million dollars. In this embodiment, the list price and income figures on the game board would be expressed in units of ten million dollars.

If billion dollar corporations are used on the game board the price per share and income number would be expressed in one billion dollar units. The value of the bank notes could be set at one billion dollars, five billion dollars, ten billion dollars and fifty billion dollars. If the game board were designed to appeal to young children, the bank notes could be five thousand dollars; one thousand dollars; five hundred dollars and one hundred dollars. In that embodiment, the price per share and income number would be expressed in terms of one hundred dollar units. The distribution of the notes would remain the same (5, 10, 10, 10).

As can be seen from these examples, the value of the shares of the corporation and the income from the corporation can vary widely and the bank notes can be adapted to reflect these changes.

THE PLAYING PAWN

Each player is provided with a playing pawn which is identical in physical form to the other playing pawns, but is distinguishable from all the others by an easily discernible characteristic, such as color or by a distinctive corporate logo or trademark. In each case, the playing pawns may be about one to two inches in height and molded or otherwise formed from an inexpensive material, such as plastic, wood or diecast metal. In the preferred form of the game, the playing pawn 36 as illustrated in FIG. 6 is a round disc mounted upright on a round pedestal base enabling it to stand erect on the game board during play. The color of each player's playing pawn corresponds to the color of his full ownership markers 38 and his bank loan markers 40 described below.

DICE

The two dice 42 used to govern the movement of the playing pawns around the board are cubes bearing one of six single numbers from 0 to 5 on each face of the cube as illustrated in FIG. 8. The front face bears the number 0; the opposite face bears the number 5; the top face bears the number 3; the bottom face bears the number 4; the right side face bears the number 1 and the left side face bears the number 2. The highest combination that can be rolled on these dice is 5+5 or 10, the lowest combination is 0+0 or 0. A zero-zero roll is a wild roll and has certain implications in the play of the game which will be more fully explained below.

The sum of the two dice is used in three ways during play. It determines the number of spaces a player may move the pawn. It also determines the number of shares a player may buy or sell during a given turn and provides the players with a mechanism for avoiding a takeover of their corporation by another player.

CORPORATE SHARES

The corporate shares 44, one of which is illustrated in FIG. 4, are used to gain control of the corporations on the game board. There are multiple shares for each of the corporations on the game board. In the preferred embodiment there are 24 corporations each having 10 shares. Possession of all 10 shares for one corporation by one player constitutes ownership of that corporation. Each share is about 2 inches×1½ inches in size and is divided horizontally into at least two portions. The upper portion 46 contains the corporation name and/or a logo corresponding to the name and/or logo on one of the corporation spaces on the game board. The lower portion 48 is color coded to correspond to the color used for the industry segment 10 on the game board which contains the corporation space 14 for the corporation. The lower portion 48 of the share also contains a price per share number 50 which corresponds to the price per share number 24 for that corporation on the game board. If the share has a third middle portion 52 it can optionally contain brief interesting facts about the corporation and/or its products.

FULL OWNERSHIP MARKER

The full ownership marker 38 is illustrated in FIG. 7. The banker holds a set of ownership markers for each player, for example a dozen. The markers correspond in color to the player's playing pawn. When one player owns and holds all of the shares of the same corporation, he owns that corporation and, the banker gives that player a full ownership mark corresponding to his pawn color.

The ownership marker is placed on the upper section 16 of the corporation space to indicate that a particular player owns 10 shares of that corporation and thus owns the corporation. At that time the banker also distributes the corresponding corporation fact sheet 54 to the owner of the corporation.

CORPORATION FACT SHEET

The corporation fact sheet 54 is an informational card which adds interest and an additional educational aspect to the game. The banker holds the fact sheets, each one corresponding to a corporation on the game board and gives them to the player at the same time that he gain full ownership and receives an ownership mark. The fact sheet is color coded to correspond to the color of the corporation's shares 44 and the game board industry segment 10 to which the corporation belongs. The corporation fact sheet contains real or fictious information about each corporation listed on the game board. The facts may include, for example, figures on sales, losses, rank in the industry, number of employees, and product information or humorous or other interesting information.

BANK LOAN MARKERS

Bank loan markers 40 as illustrated in FIG. 5 are held by the bank. There is one bank loan marker for each player and it corresponds in color to the player's playing pawn and ownership marker. Each loan marker bears the name and/or logo or trademark of a real or fictitious United States or foreign bank or lending institution. The loan marker is placed on a corporation space when a player has used the shares of a corporation which he owns as collateral for a bank loan. There is only one loan marker per player, and a player may only have one loan outstanding at a time as is explained more fully below.

BUYING AND SELLING CHART

The Buying and Selling Chart illustrated in FIG. 9 may be used to facilitate the purchase and sale of shares of corporations. The chart calculates the costs of multiple shares. To find the total amount to be paid to the bank for a number of shares, the player reads down the vertical "PRICE PER SHARE COLUMN" to a number which corresponds to the price per share number 50 listed on the corporation share which he wants to buy. The player then finds the number of shares being purchased by following across the horizontal column and stopping at that column. The total price to be paid to the bank for the shares appears where the two columns meet. To find the income to be received from a given corporation, the player looks down the price per share column for the income number 20 listed on the particular corporation space. The total amount to be received from the bank for the sale of the shares appears under the price per share column. For example, when buying six shares of Corporation P at 700. The amount to be paid the bank is 4B200 or 4 billion 200 million dollars; Income from the same number of shares is 4B800 or 4 billion 800 million dollars. The chart would be varied depending upon the denomination of the bank notes used in the game.

THE PLAY OF THE GAME

Prior to commenceing play, the players select the banker. Starting with the banker, the players roll the dice to determine the order of play, the highest number being first, etc. If there is a tie, the dice are rolled again. The players select their playing pawn and place them on the situation space labeled START:ANY PLAY. The banker distributes the money as described above under bank notes.

(A) EARNING INCOME

There are seven possible ways for players to earn income during the play of the game. A player receives income from the bank in the amount indicated by the income figure 20 on the corporation space immediately upon assuming ownership of a corporation (10 shares). Each time during play that the owner of a corporation lands on his own corporation space, income in the amount of the corporation income figure 20 is paid to him by the bank.

A player can also earn additional income by selling individual corporate shares to other players above the list price 24 and by selling fully owned corporations back to the bank and to other players at a profit.

Income is realized on the sale of fully owned corporations because the value of a corporation increases by the price of one share when full ownership is achieved and each time the player acquires another corporation in the same industry the price is increased by the value of one share. This can be illustrated by the following example.

EXAMPLE 2

Corporation A is in the same Industry as Corporation D. If a player buys 10 shares of Corporation D for 1 billion dollars (100 million dollars per share), the value of the ten shares in Corporation D immediately increases to 1 billion, 100 million when the ownership marker is first acquired from the bank. If the player then sells the Corporation D back to the bank or another player he realizes a 100 million dollar profit. If the player also acquires full ownership of Corporation A which is in the same industry as D, the total value of Corporation D increases by another 100 million dollars (the value of one share) and the player would realize a 200 million dollar profit on selling Corporation D back to the bank or to another player. This increase in the value of each corporation continues for each corporation acquired by the same player in the same industry.

A player also receives as income an amount equal to the income figure 20 for each corporation he owns each time he lands on the START:ANY PLAY space as explained in detail below (Section C). Income can also be earned by rolling zero-zero on the dice under specific circumstances which are explained in more detail below (Section D).

(B) NEGOTIATING BANK LOANS

A player may negotiate a loan of money during the play of the game. Each player has only one bank loan marker and may only have one outstanding loan at a time. A loan can be obtained only against a corporation which the player owns and may be negotiated only when the player lands on the corporation space corresponding to the corporation which is to be used as collateral for the loan. Only fully owned corporations can be used as collateral for a loan and the amount of the loan must be equal in amount to the value of ten shares of the corporation.

When a loan is made against a corporation, the player receives the money from the banker in addition to a bank loan marker which is placed on the corporation space corresponding to the corporation whose shares are being used as collateral for the loan. The ten shares of this corporation being used as collateral are placed face down on the game board to indicate the existence of a loan. The loan can be paid back by the player one share at a time or all at one time. Each time the player with an outstanding loan passes the corporation space with the loan marker the player must pay off the value of one share of the loan and pay the value of one share as interest to the bank. If the player holding the loan actually lands on the corporation space for the corporation which is being used as collateral for the loan, the player must pay back the loan in full plus the value of one share as interest.

The loan may be paid back without payment of interest if a player holding a loan lands on the situation space labeled START:ANY PLAY. A loan must be paid off if a corporation is acquired by another player and no player can be declared the winner of the game if he has an outstanding loan even though he may control four corporations in the same industry.

(C) SITUATION SPACE—START:ANY PLAY

If during the play of the game a player lands on the situation space labeled START:ANY PLAY *22a*, a variety of options are available to the player. The player may acquire corporation shares in any corporation held by the bank up to the number rolled on the dice.

As explained above, on landing on START:ANY PLAY, a player who owns one or more corporations automatically collects income equal to the income figure 20 for each corporation. He may also pay off any outstanding loan without interest when landing on START:ANY PLAY. By rolling zero-zero after landing on START:ANY PLAY, the player may acquire any fully owned corporation from another player at the highest asking price but without paying a bonus. On rolling 5+5 or zero+zero after landing on START:ANY PLAY, the player may acquire ten shares in one or more corporations or several corporations which are held by the bank.

(D) RULES FOR ZERO-ZERO DICE ROLLS

A roll of zero-zero on the dice means that no movement occurs from the space occupied by the player on his previous turn. When zero-zero is rolled from a situation space, however, some new circumstances are created. If zero-zero is rolled after landing on the Corporation Tax situation space the player does not pay any additional tax but collects all money currently in the government contract fund box. If zero-zero is rolled after a player lands on a Loss situation space, the player does nothing on that turn.

If zero-zero is rolled after landing on a corporation space which is not owned by any player, the player rolling zero-zero may acquire ten shares of that corporation from the bank at list price. If zero-zero is rolled from a corporation space and the corporation is partially owned by the bank and other players, the player rolling zero-zero may acquire all shares held by the bank at list price. The other players can stop the acquisition of their shares by challenging the acquisition. This is done if the challenging player rolls 5+5 or zero-zero. If any other numbers are rolled, the acquisition is not stopped and the player acquiring the shares must pay each unsuccessful challenger a bonus of 100 million dollars above the list price.

The play of the game will now be described in more detail. The first player throws both dice and moves the pawn clockwise from START:ANY PLAY around the board the number of spaces corresponding to the number rolled on the dice. If a player lands on a corporation space that is not owned, the player may pass or buy one or more shares in the corporation up to the combined number rolled on the dice. This can be illustrated by the following example.

EXAMPLE 3

A player on START:ANYPLAY rolls a combination of 1+3 (4) the player moves four spaces to the corporation space for Corporation D. The price per share 24 of Corporation D is indicated by the number in the lower section 22, in this case, 300 million dollars for each share. The player may buy up to 4 shares of the stock in Corporation D. The amounts to be paid for one, two, three or four shares can be determined quickly by consulting the buying and selling chart. If the player lands on a corporation whose shares are held, both by other players and by the bank, he may attempt to buy shares from all sources. First he may buy shares from the bank up to the roll of his dice at the lowest price. If he has not purchased shares up to the number he rolled, he can then attempt to acquire additional shares held by the other players. A player cannot acquire shares from another player if the number of shares held by that player is greater than the number the player attempting to acquire shares rolled on the dice. The player holding the shares which another player is attempting to acquire, may fight the acquisition by rolling a higher number on the dice than the player attempting to take over his shares. If successful, the player attempting the acquisition or take over of shares must pay a bonus above the list price for the other players' shares to each player whose shares are taken over. If the players whose shares are being acquired do not challenge the take over by attempting to roll numbers higher than that rolled by the player atttempting the take over, they receive a bonus of 100 million dollars times the acquiring players roll of the dice. If the players whose shares are being acquired attempt to challenge the acquisition and by rolling a higher number and fails, they receive a bonus equal to the amount they rolled on the dice times 100 million dollars. This can be illustrated by the following example.

EXAMPLE 4

Player D rolls a five and lands on Corporation O, whose shares are selling from the bank for 100 million dollars a share. Player A holds five shares of Corporation O, player B holds 2 shares of corporation O and player C holds 1 share of Corporation O. Player D cannot take over player A's five shares because he needs a roll of six to do so. Player D can, however, buy two shares from the bank for 100 million dollars each by paying 200 million dollars to the bank. Player B with two shares of Corporation O can roll the dice to try to stop the take over of his two shares by player D. Player B rolls a three which is lower than player D's roll of five, whose is attempting the take over and therefore player D can proceed to buy the two shares. Player B is, therefore, paid 200 million dollars by player D for two shares of Corporation O plus a bonus of 300 million dollars because he rolled a three. Player C who holds one share of Corporation O chooses not resist the take over attempt and because player D rolled a five accepts a 500 million dollar bonus above the 100 million dollar per share price. The highest bonus that may be paid to a player in a take over would be 100 million dollars times 10 (1 billion dollars). The bonus is always the amount paid to the seller over and above the list price of the stock.

In order to take over a corporation which is fully owned, a player attempting to acquire the corporation must either land on that corporation's space on a roll of a ten; be on that corporation when rolling zero-zero, or have rolled five+five on the START:ANY PLAY Situation Space.

Movement around the game board continues until one player, who owns four corporations in one industry and does not have a bank loan outstanding, is declared the winner. In order to lengthen the game, play can continue until one player owns all the corporations in two industries (double play) or in three industries (triple play). The playing time can be shortened if a fixed playing time is set at the start of play. The player with the highest corporate assets at the end of the fixed time is declared the winner.

I claim:

1. A business and finance game apparatus for play by two or more players comprising:

a game board on which is imprinted a track having an inner and outer circumference, radially divided into several industry segments each of which is radially subdivided into several corporation spaces each corporation space designated with the name of the corporation, and an income and price per share number for each corporation, each segment being separated by a single situation space which allows the player the opportunity to buy and sell shares at the price per share which corresponds to the price per share number on the corporation space, collect income, pay off loans and pay taxes;

a plurality of bank notes;

a set of ten corporate shares corresponding to each corporation space, bearing the same price per share number that appears on the corporate space;

two or more playing pawns employed to designate movement of the player around the board; and means for simultaneously governing movement of said playing pawn around the board and directing the maximum number of shares of a corporation a player may purchase upon landing on a corporation space, said means comprising a pair of dice each die bearing on each face a different single number from zero to five wherein the sum of the top exposed die faces corresponds to the maximum number of shares which can be purchased on the landing.

2. The game apparatus of claim 1 wherein said bank notes are in denominations of five billion, one billion, five hundred million and one hundred million dollars.

3. The game apparatus of claim 1 wherein the apparatus also includes a set of corporate shares corresponding to each corporation space on the game board, a set of full ownership markers identifying when a corporation is owned by a player and corporation fact sheets corresponding to each corporation space on the game board and bearing facts about the corporation.

4. The game apparatus of claim 1 wherein the track is a separate interchangeable piece which is set into the game board.

5. The game apparatus of claim 1 wherein the corporate spaces are separate interchangeable pieces which are set into the track on the game board.

6. The game apparatus of claim 1 wherein the industry segments are separate interchangeable pieces set into the track on the game board.

7. A business and finance game apparatus for play by two or more players comprising:

a game board on which is imprinted a circular track having an inner and outer circumference, radially divided into six industry segments each of which is radially and bearing facts about the corporation which are awarded to a player when ten shares of a corporation is obtained.

* * * * *

UNITED STATES PATENT AND TRADEMARK OFFICE

CERTIFICATE OF CORRECTION

PATENT NO. : 4,535,994

DATED : August 20, 1985

INVENTOR(S) : William P. Cowan

It is certified that error appears in the above-identified patent and that said Letters Patent is hereby corrected as shown below:

Col. 12, line 12, after "radially" insert --subdivided into four corporation spaces each corporation space designated with the name of the corporation, and an income and price per share number for each corporation, each segment being separated by a single situation space which allows the player the opportunity to buy and sell shares at the price per share which corresponds to the price per share number on the corporation space, collect income, pay off loans and pay taxes;

a plurality of bank notes in denominations of five billion, one billion, five hundred million and one hundred million dollars;

two or more playing pawns employed to designate movement of the player around the board;

UNITED STATES PATENT AND TRADEMARK OFFICE

CERTIFICATE OF CORRECTION

PATENT NO. : 4,535,994
DATED : August 20, 1985
INVENTOR(S) : William P. Cowan

It is certified that error appears in the above-identified patent and that said Letters Patent is hereby corrected as shown below:

means for simultaneously governing movement of said playing pawns around the board and directing the maximum number of shares of a corporation a player may purchase upon landing on a corporate space, said means comprising a pair of dice each die bearing on each face a different single number from zero to five wherein the sum of the top exposed die faces corresponds to the maximum number of shares which can be purchased on the landing;

a set of ten corporate shares corresponding to each corporation space bearing the same price per share number that appears on the corporate space;

a set of full ownership markers identifying when all ten shares of a corporation are owned by a single player; and

UNITED STATES PATENT AND TRADEMARK OFFICE

CERTIFICATE OF CORRECTION

PATENT NO. : 4,535,994

DATED : August 20, 1985

INVENTOR(S) : William P. Cowan

It is certified that error appears in the above-identified patent and that said Letters Patent is hereby corrected as shown below:

twenty four corporation fact sheets, one corresponding to each corporation space on the game board--

Signed and Sealed this

*Eighteenth* Day of *March 1986*

[SEAL]

*Attest:*

DONALD J. QUIGG

*Attesting Officer*

*Commissioner of Patents and Trademarks*